US008099809B2

(12) United States Patent
Tanaka et al.

(10) Patent No.: US 8,099,809 B2
(45) Date of Patent: Jan. 24, 2012

(54) MATTRESS

(75) Inventors: Makoto Tanaka, Tokyo (JP); Akira Nishimura, Tokyo (JP); Yumiko Mori, Tokyo (JP)

(73) Assignee: Paramount Bed Co., Ltd., Tokyo (JP)

( * ) Notice: Subject to any disclaimer, the term of this patent is extended or adjusted under 35 U.S.C. 154(b) by 0 days.

(21) Appl. No.: 12/093,696

(22) PCT Filed: Aug. 22, 2006

(86) PCT No.: PCT/JP2006/316413

§ 371 (c)(1),
(2), (4) Date: Oct. 28, 2008

(87) PCT Pub. No.: WO2007/099657

PCT Pub. Date: Sep. 7, 2007

(65) Prior Publication Data

US 2009/0094743 A1 Apr. 16, 2009

(30) Foreign Application Priority Data

Feb. 28, 2006 (JP) ..... 2006-051623

(51) Int. Cl.

| | |
|---|---|
| ***A47B 1/00*** | (2006.01) |
| *A61G 1/00* | (2006.01) |
| *A61G 7/00* | (2006.01) |
| *A61G 5/00* | (2006.01) |

(52) U.S. Cl. ..... 5/628; 5/81.1 T; 5/625; 5/626; 224/158

(58) Field of Classification Search ..... 5/81.1 R, 5/81.1 HS, 81.1 T, 628, 625, 420, 626, 694; 128/869, 870, 873–875; 224/18, 158
See application file for complete search history.

(56) References Cited

U.S. PATENT DOCUMENTS

| | | | | |
|---|---|---|---|---|
| 5,317,770 | A | 6/1994 | Sakurai et al. | |
| 6,055,988 | A * | 5/2000 | Perisho | 128/869 |
| 6,443,157 | B1 * | 9/2002 | Sargent | 128/870 |
| 7,962,983 | B2 * | 6/2011 | Keesaer et al. | 5/627 |
| 2003/0066134 | A1 * | 4/2003 | Chapman | 5/628 |

FOREIGN PATENT DOCUMENTS

| | | | |
|---|---|---|---|
| JP | 62-108958 | U | 7/1987 |
| JP | 6-21466 | Y2 | 6/1994 |
| JP | 2003-135221 | A | 5/2003 |
| JP | 2004-358005 | A | 12/2004 |

* cited by examiner

*Primary Examiner* — Jonathan Liu
(74) *Attorney, Agent, or Firm* — McDermott Will & Emery LLP

(57) ABSTRACT

This invention proposes a mattress formed by covering a padding with a covering material, characterized in that the covering material has grip portions fixed to the longitudinal edges near the corners of the mattress, that the ends on one side of multiple fastening belts are fixed to both the longitudinal edges, that stowing portions for stowing the fastening belts are provided, and that fastening members are fixed at the ends on the other side of the fastening belts.

9 Claims, 6 Drawing Sheets

MATTRESS

CROSS-REFERENCE TO PRIOR APPLICATIONS

This is a U.S. national phase application under 35 U.S.C. §371 of International Patent Application No. PCT/JP2006/316413, filed Aug. 22, 2006, and claims the benefit of Japanese Application No. 2006-051623, filed Feb. 28, 2006, both of which are incorporated by reference herein. The International Application was published in Japanese on Sep. 7, 2007 as International Publication No. WO 2007/099657 A1 under PCT Article 21(2).

TECHNICAL FIELD

The present invention relates to a mattress used mainly in hospitals, other medical facilities, elderly health-care facilities, etc.

BACKGROUND ART

In cases where disasters such as fires and earthquakes occur in hospitals, other medical facilities, elderly health-care facilities, etc., stretchers are often used to manually carry people who cannot take refuge by themselves such as patients unable to walk and bedridden patients, to safe places for evacuation. In such cases, if elevators stop, those people must be carried through stairways.

These evacuation activities include the work of transferring each patient from the bed to a stretcher and the work of carrying the patient placed on the stretcher to a safe place. In general, 2 to 4 persons are necessary for carrying one patient by means of a stretcher to a safe place.

For the purpose of quickly performing such evacuation work with less manpower, for example, Patent Document 1 proposes a stretcher comprising a cushiony mattress. The stretcher of Patent Document 1 comprises a cushiony bendable mattress having cylindrical holding portions along the longitudinal edges of the mattress on both sides, with a shoulder belt inserted through each of the cylindrical holding portions; the shoulder belts extending from the respective ends of the cylindrical holding portions provided along both the longitudinal edges of the mattress are connected with each other to form loops at both the ends in the longitudinal direction; multiple fastening belts with their ends on one side fixed to both the longitudinal edges are disposed to oppose each other and lie in the transverse direction of the mattress, with intervals kept between them in the longitudinal direction of the mattress; and buckles are fixed as fastening members to the ends on the other side of the fastening belts opposing each other.

According to JP6-21466Y, the stretcher with the above constitution can be compactly stowed and can be used to efficiently and easily carry a person, and further since it is cushiony, even if the stretcher with a patient on it is carried and placed on the ground, etc. to wait for any further action, the patient can remain comfortable on the stretcher.

DISCLOSURE OF THE INVENTION

Problem to be Solved by the Invention

The abovementioned stretcher of Patent Document 1 uses a mattress, but it is not supposed at all that when the stretcher is not used as a stretcher, the stretcher is used as a mattress on which a person can lie. That is, since it "can be compactly stowed," it is destined to be stored in any place while it is not used as a stretcher.

If this stretcher is used as an ordinary mattress while it is not used as a stretcher, the shoulder belts and fastening belts exposed outside the mattress may disturb the patient, elderly person or the like using the mattress when he/she leaves from the bed, since he/she may be caught by the belts and fall down. Further, in the case where the bed is an electric bed, when the bed bottom is raised, lowered or tilted, the belts may be caught in a mechanical member, to prevent the bed movement or to damage the mattress inconveniently. After all, the stretcher cannot be used as an ordinary mattress. The present invention has been created in view of the above situation. The object of this invention is to provide a mattress that can be used as a stretcher when a disaster occurs and can also be used as an ordinary mattress when it is not used as a stretcher.

Means for Solving the Problem

To solve the abovementioned problem, this invention proposes a mattress formed by covering a padding with a covering material, characterized in that the covering material has grip portions fixed to the longitudinal edges near the corners of the mattress, that the respective ends on one side of multiple fastening belts are fixed to both the longitudinal edges, that stowing portions for stowing the fastening belts are provided, and that fastening members are fixed at the ends on the other side of the fastening belts.

Further, this invention proposes the abovementioned constitution, wherein each of the grip portions is a looped belt.

Further, this invention proposes the abovementioned constitution, wherein each pair of the fastening members is a buckle consisting of a male part and a female part to achieve fastening by resilient engagement between the engagement pieces of the male and female parts, and the male part is attached to each of the fastening belts fixed to one of the longitudinal edges while the female part is attached to each of the fastening belts fixed to the other longitudinal edge.

Further, this invention proposes the abovementioned constitution, wherein the padding is bendable.

Further, this invention proposes the abovementioned constitution, wherein the stowing portions can be opened and closed.

Effects of the Invention

In the mattress of this invention, multiple fastening belts are fixed to both the longitudinal edges, but since these fastening belts are folded and stowed in the stowing portions without being exposed outside the mattress, they neither disturb the user nor is obtrusive in appearance. On the other hand, each of the grip portions provided at the longitudinal edges near the corners is, for example, a looped belt or the like, the grip portions are not so dimensionally long and do not disturb the user like the handles provided along the longitudinal edges of an ordinary mattress.

Therefore, even if the mattress of this invention is used as an ordinary mattress, it does not happen that the patient, elderly person or the like using the mattress is caught by the fastening belts, to fall down, when he/she leaves from the mattress. Further, even if the bed is an electric bed, it does not happen that when the bed bottom is raised, lowered or tilted, the fastening belts are caught by a mechanical member, to prevent the bed movement or to damage the mattress inconveniently.

In the case where a disaster such as a fire or earthquake occurs while the mattress is used as an ordinary mattress, the stowing portions are opened to take out the fastening belts, and the respective pairs of fastening belts opposing each other in the transverse direction of the mattress are connected with each other using the fastening members, to stably secure the patient or the like on the mattress.

Therefore, in this state, a nurse or the like can hold the grip portions, to move the mattress, and the patient or the like stably secured on the mattress can be safety carried to a safe place.

In the above, if the padding is bendable, the above tight fastening operation can bend the mattress, to bring both the longitudinal edges closer to each other, thus deforming the mattress in U shape. In this case, since the U-shaped mattress embraces the patient or the like in cooperation with the multiple pairs of fastening belts, the patient can be safely and stably secured.

Therefore, in this state, a nurse or the like can hold the grip portions, to move the mattress, so that the patient or the like stably secured on the mattress can be safely carried to a safe place.

In the case where sufficient manpower is available, the mattress can of course be moved by multiple persons, but if the manpower is insufficient, one nurse or the like can hold appropriate grip portions, for examples, the grip portions near the head of the patient or the like stably secured on the mattress, to drag and move the mattress.

The mattress of this invention used as described above contains the padding necessary for use as an ordinary mattress. Therefore, even if there is an obstacle such as a level difference when the mattress is dragged and moved, the impact by the obstacle can be absorbed by the padding without displeasing the patient or the like stably secured on the mattress.

DETAILED DESCRIPTION OF THE INVENTION

Figure 1:
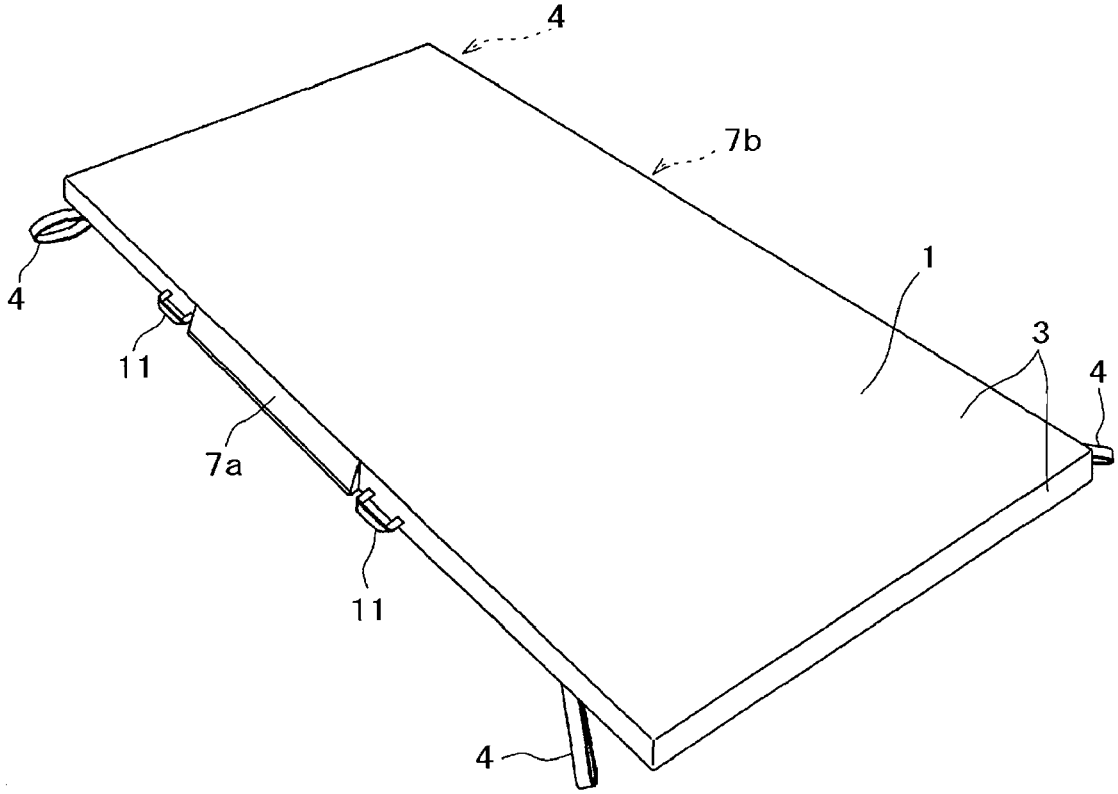
FIG. 1 is a perspective illustration showing the appearance of the mattress of this invention.

Embodiments of the mattress of this invention are explained below in reference to attached FIGS. 1-10.

In these drawings, symbol 1 denotes the appearance of a mattress. The mattress 1 is formed by covering a padding 2 with a covering material 3 like a conventional mattress. The padding 2 can be any appropriate padding used in an ordinary mattress, but it is desirable to use a bendable padding 2 in this invention.

In the mattress 1 of this invention, grip portions 4 are fixed to the covering material 3 at the longitudinal edges near the corners of the mattress. In this embodiment, each of the grip portions 4 is a looped belt.

Further, the ends on one side of multiple (two each in this example) fastening belts 6*a* and 6*b* are fixed to the covering material 3 at both the longitudinal edges of the mattress 1, with an interval kept between them in the longitudinal direction, and openable and closable stowing portions (also referred to as one or more longitudinal pockets) 7*a* and 7*b* for stowing respectively two fastening belts 6*a* or 6*b* are provided. Meanwhile, in the drawings, the parts of one of the longitudinal edges are indicated by subscript a, and the parts of the other longitudinal edge are indicated by subscript b.

In this embodiment, each of the stowing portions (i.e. longitudinal pockets) 7 can be opened and closed using a slide fastener, but instead of the slide fastener, a plane fastener such as a loop-hook fastener or snaps can also be used for opening and closing each stowing portion.

Meanwhile, contrary to the abovementioned embodiment wherein the stowing portions 7*a* and 7*b* can be opened and closed, in another embodiment, the openings of the stowing portions 7*a* and 7*b* can be closed by sewing in a relatively easy and simple manner, so that the sewn openings can be ripped to take out the fastening belts 6*a* and 6*b* and so that once the sewn openings of the stowing portions are ripped, they cannot be closed immediately.

Further, fastening members 9*a* and 9*b* are fixed at the ends on the other side of the respective fastening belts 6*a* and 6*b*, so that the respective fastening belts 6*a* and 6*b* provided as pairs in opposite to each other in the transverse direction of the mattress 1 can be connected with each other by the fastening members 9*a* and 9*b*. In this embodiment, either the fastening belts 6*a* or 6*b* (the fastening belt 6*a* in this case) can be adjusted in the length up to the fastening member") 9*a*.

In this embodiment, a pair consisting of a fastening member 9*a* and a fastening member 9*b* is a buckle consisting of a male part 9*a* and a female part 9*b* to achieve fastening by the resilient engagement between the engagement pieces of the male and female parts. On the male part 9*a* side, the fastening belt 6*a* can be adjusted in length as described above. Since the constitution of the buckle and the length adjustment are obvious, their further explanation is not made here.

Meanwhile, the length of the fastening belt 6*a* on the male part 9*a* side can be set at an appropriate length beforehand. So, the male part 9*a* can also be fixed at the other end of the fastening belt 6*a* with a predetermined length like the female part 9*b*, so that the length cannot be adjusted. That is, on the side of either the male part 9*a* or the female part 9*b*, the fastening belt 6*a* or 6*b* can be adjusted in length, or it is possible that neither the fastening belt 6*a* nor the fastening belt 6*b* can be adjusted in length.

In FIG. 1, each symbol 11 denotes a handle as attached to an ordinary mattress, to be used for carrying the mattress 1.

Figure 2:
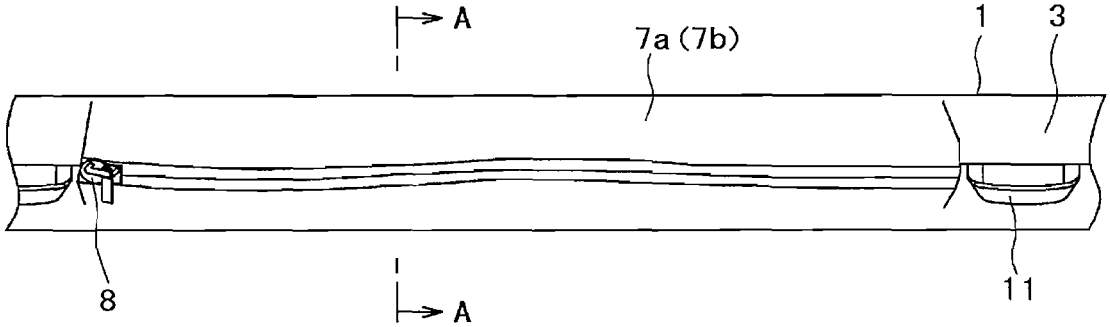
FIG. 2 is an expanded elevation showing an important portion of a longitudinal edge of the mattress of this invention.
Figure 3:
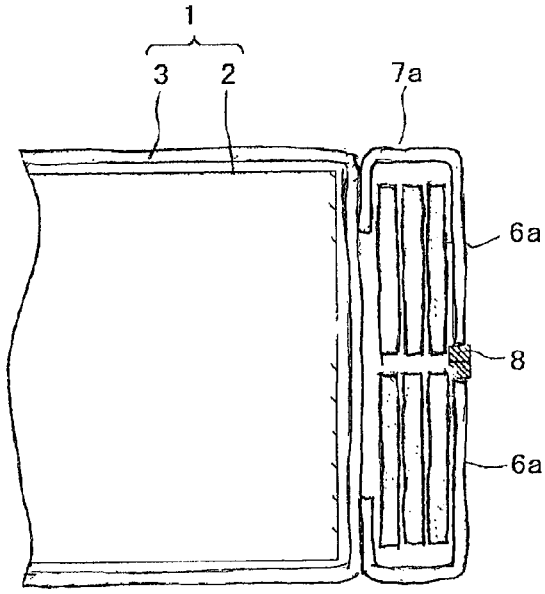
FIG. 3 is a cross-section A-A of FIG. 2.
Figure 4:
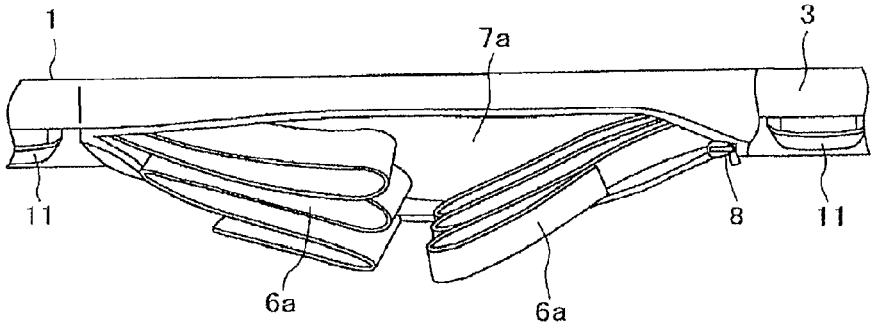
FIG. 4 is an expanded elevation showing an operation in the portion of FIG. 2.

In the abovementioned constitution of this embodiment, the mattress 1 has multiple (two each in this case) fastening belts 6*a* and 6*b* fixed to both the longitudinal edges. These fastening belts 6*a* and 6*b* are folded and stowed in the respective stowing portions 7*a* and 7*b*, the openings of which are closed by fasteners 8, so that the fastening belts can be hidden inside without being exposed to outside the mattress 1 as shown in FIGS. 1 and 2. Thus, the fastening belts do not disturb the user and are not obtrusive in appearance. On the other hand, since the grip portions 4 attached to the longitudinal edges near the corners are not required to be dimensionally long as shown in FIG. 1, the grip portions are not disturbing the user like the handles 11 attached to the longitudinal edges of an ordinary mattress.

Therefore, even if the mattress 1 of this invention is used as an ordinary mattress, it does not happen that the patient, elderly person or the like using the mattress is caught by belts, to fall down, when he/she leaves from the bed, and even if the bed is an electric bed, it does not happen that when the bed bottom is raised, lowered or tilted, the fastening belts are caught by a mechanical member, to prevent the bed movement or to damage the mattress inconveniently.

Figure 5:
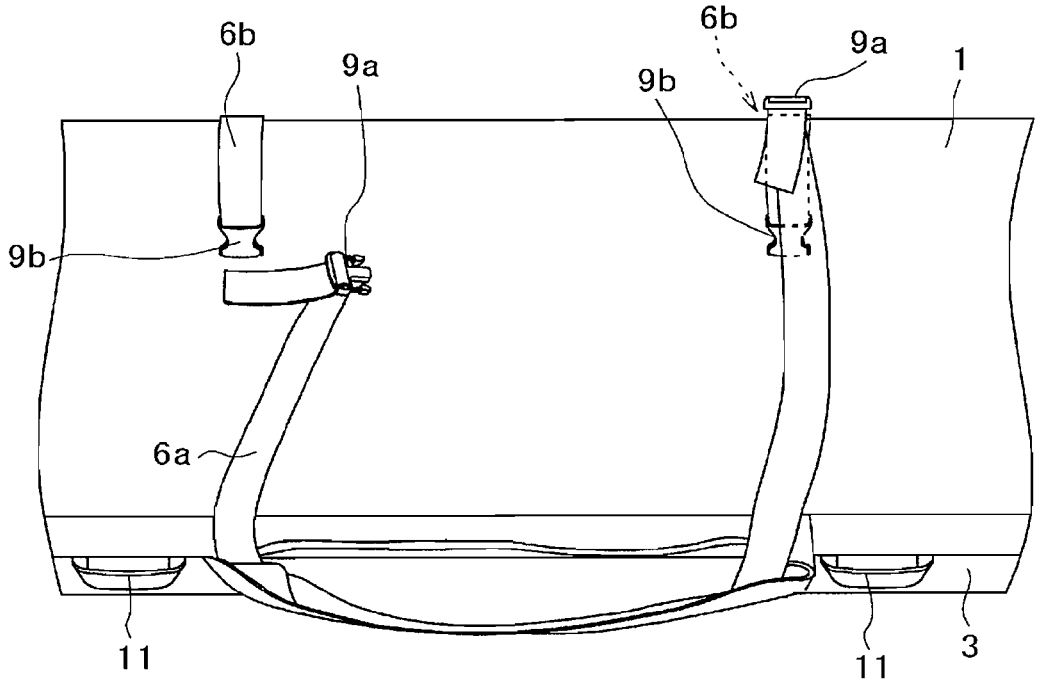
FIG. 5 is a perspective illustration of an important portion showing how the mattress of this invention is going to be used as a stretcher.
Figure 6:
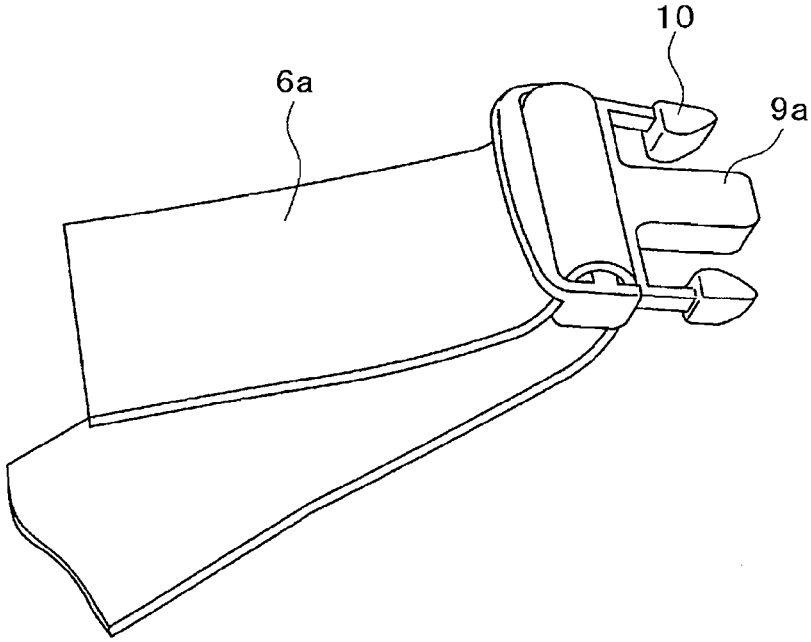
FIG. 6 is a perspective illustration showing a fastening member of a fastening belt on one side.
Figure 7:
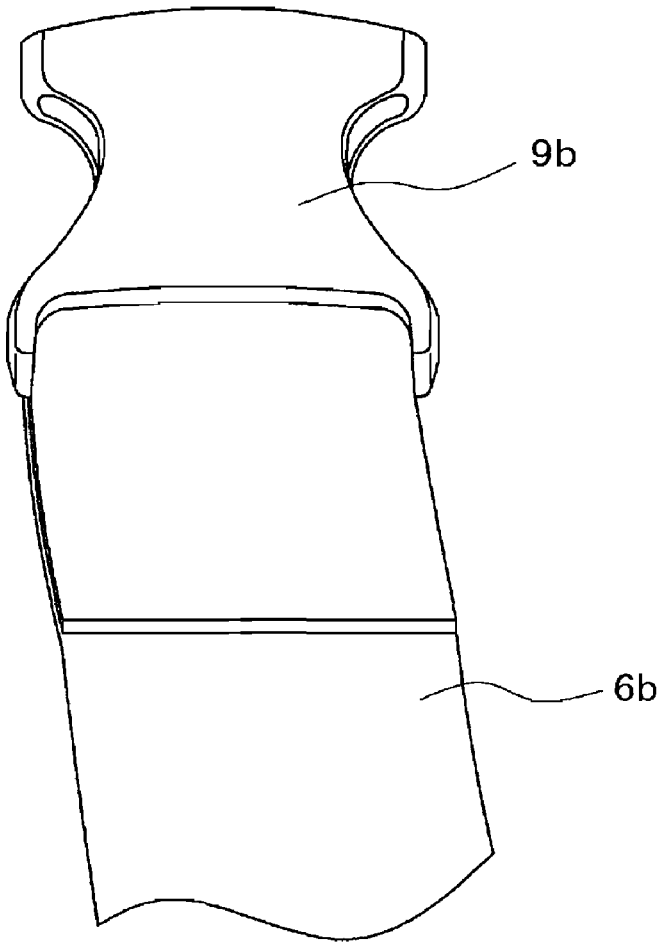
FIG. 7 is a perspective illustration showing a fastening member of a fastening belt on the other side.
Figure 8:
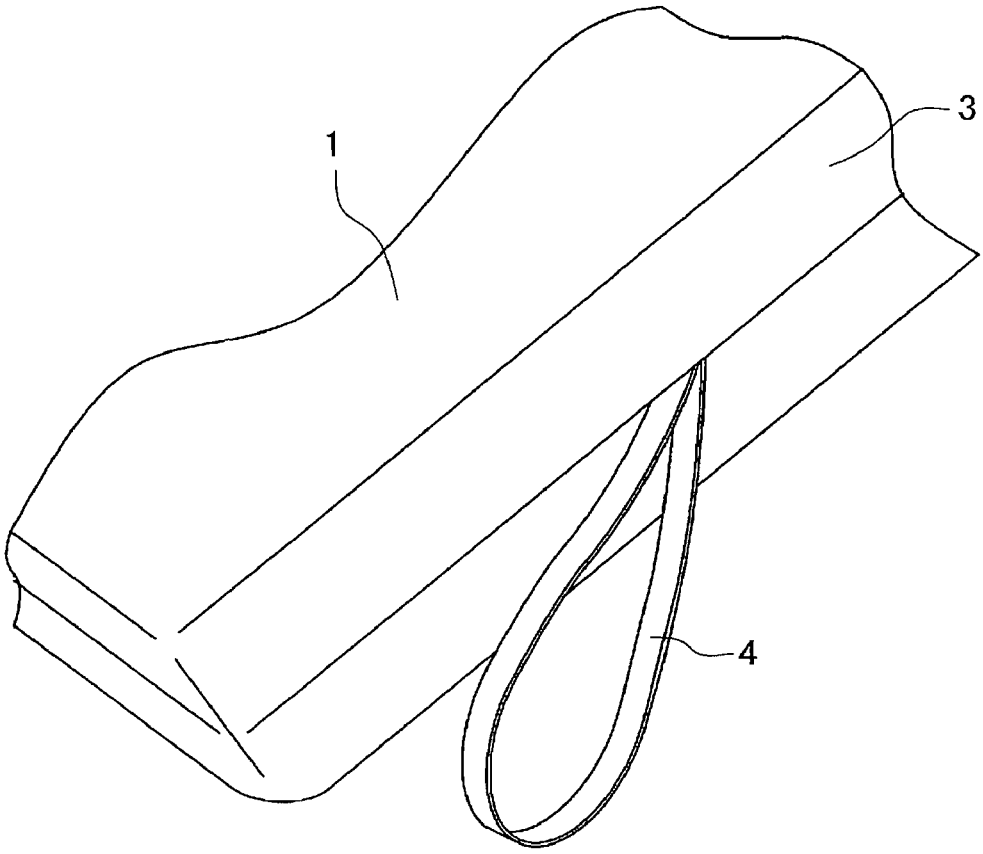
FIG. 8 is a perspective illustration showing a corner of the mattress of this invention.

In the case where a disaster such as a fire or earthquake occurs while the mattress 1 is used as an ordinary mattress, the stowing portions 7*a* and 7*b* are opened to take out the fastening belts 6*a* and 6*b*, and as shown in FIG. 5, the fastening belts 6*a* and 6*b* in opposite to each other in the transverse direction of the mattress are connected with each other as pairs using the fastening members 9*a* and 9*b*. Then, the fastening belts 6*a* on one side are pulled to achieve tight fastening.

Figure 9:
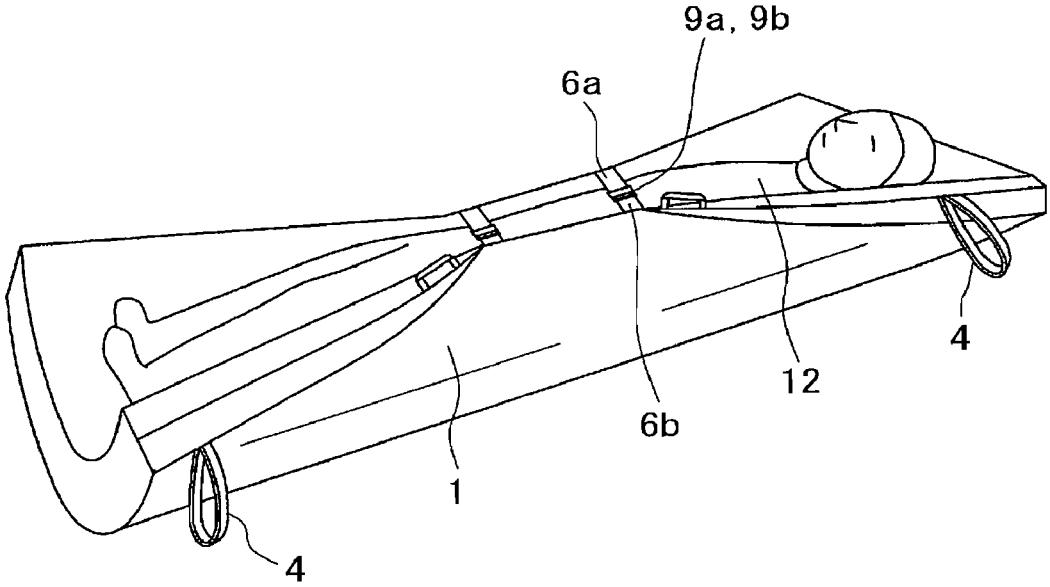
FIG. 9 is a perspective illustration showing how the mattress of this 6 invention is used as a stretcher.

In this case, if the padding used is bendable, the above tight fastening operation can bend the mattress, to bring both the longitudinal edges of the mattress 1 closer to each other by the fastening belts 6*a* and 6*b* as shown in FIG. 9, thus deforming the mattress 1 in U shape. In this case, since the U-shaped mattress 1 embraces the patient or the like 12 in cooperation of the multiple (two in this case) pairs of fastening belts 6*a* and 6*b*, the patient or the like can be safely and stably secured.

Therefore, if the nurse or the like holds the grip portions 4, to move the mattress 1 in this state, the patient or the like 12 stably secured in the mattress 1 can be safely carried to a safe place.

Figure 10:
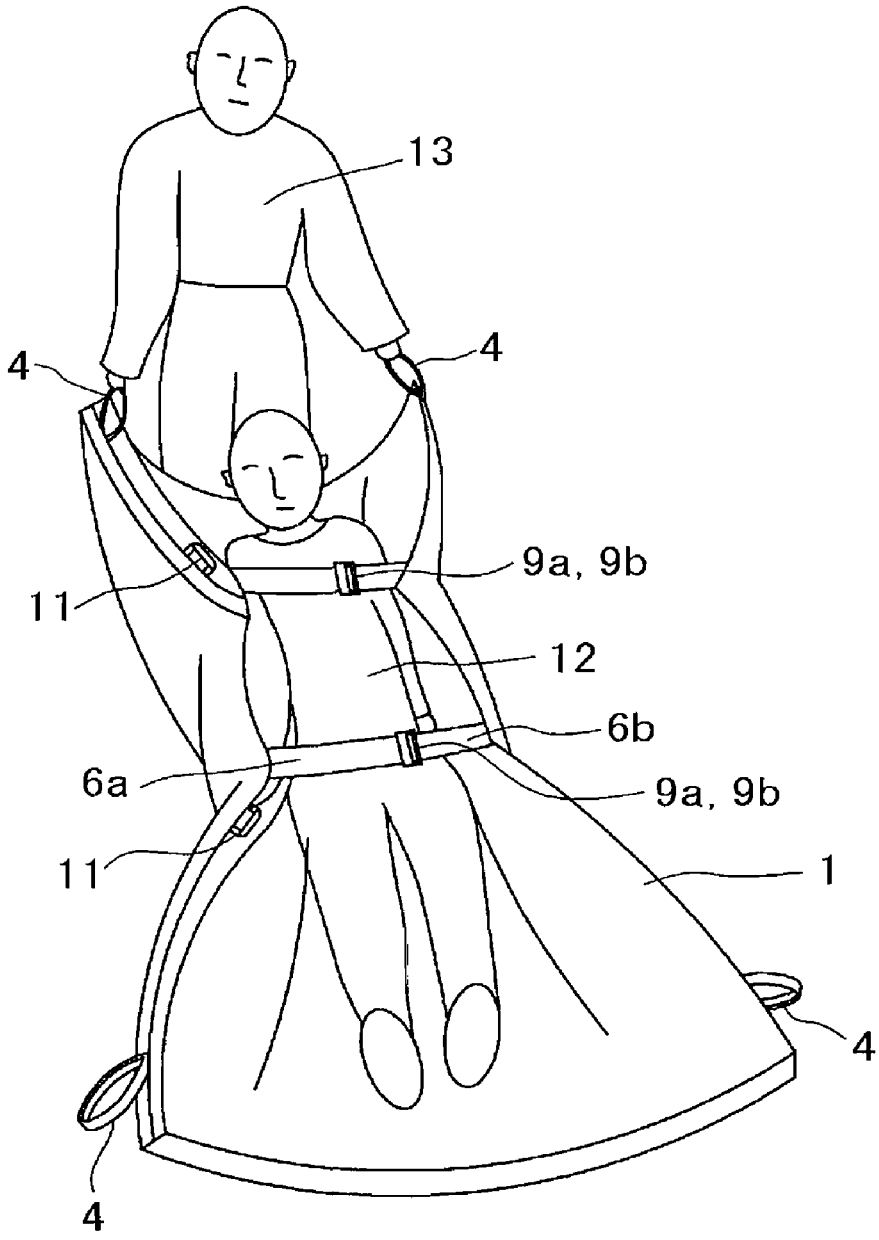
FIG. 10 is another perspective illustration showing how the mattress of this invention is used as a stretcher.

If there is sufficient manpower, the mattress 1 can be carried by multiple persons, but if the manpower is insufficient, one nurse or the like 13 can hold appropriate grip portions of the mattress, for example in the case shown in FIG. 10, the grip portions 4 on the head side of the patient or the like 12 stably secured on the mattress 1, to drag and move the mattress 1.

In this case, the mattress 1 of this invention contains the padding 2 necessary for use in an ordinary mattress. Therefore, even if there is an obstacle such as a level difference when the mattress is dragged and moved, the impact can be absorbed by the padding without displeasing the patient or the like stably secured on the mattress.

Since this invention is as described above, the mattress used as an ordinary mattress by a person unable to take refuge by himself/herself such as a patient unable to walk or bedridden patient can be safely carried as a stretcher with the patient on it to a safe place for evacuation when a disaster occurs.

Further, in this invention, even one nurse or the like can use the mattress safely as a stretcher when a disaster occurs, and the padding cushiony as in an ordinary mattress absorbs and eases the impact caused when the mattress is dragged and moved, without displeasing the patient or the like.

The invention claimed is:

1. A mattress for ordinary and emergency use by a user, comprising:

padding having at least two longitudinal edges, each having a length, and a width;

a covering material enclosing the padding and having at least two long edges and a plurality of corners;

grip portions attached along the long edges proximate to at least one of the corners;

a plurality of fastening belts attached at a fixed end to the long edges, a portion of the plurality of fastening belts are attached on opposing long edges;

fastening members attached to the plurality of fastening belts opposite the fixed end; and at least one longitudinal pocket enclosing an entirety of at least one of the plurality of the fastening belts and fastening members;

wherein the longitudinal pocket is formed on an outside of the covering material along at least one of the two long edges and the at least one of the plurality of belts is stored between the covering material and the longitudinal pocket;

wherein during ordinary use, the padding is laid flat and extended to approximately a full length of the two longitudinal edges, and the longitudinal pocket encloses the portion of the plurality of the fastening belts and fastening members; and wherein during emergency use, the fastening belts and fastening members are removed from the longitudinal pocket, the padding is bent along a line in the longitudinal direction to bring the longitudinal edges closer to each other and at least one pair of fastening belts removably secure to each other to maintain the padding in the bent condition.

2. The mattress for ordinary and emergency use, according to claim 1, wherein each of the grip portions is a looped belt.

3. The mattress for ordinary and emergency use, according to claim 1, wherein an opposing pair of the fastening members comprise a buckle consisting of a male part and a female part to achieve fastening by resilient engagement between the engagement pieces of the male and female parts, wherein the male part is attached to one of the fastening belts fixed to one of the long edges while the female part is attached to another of the fastening belts fixed to another long edge.

4. The mattress for ordinary and emergency use, according to claim 1, wherein the padding is bendable.

5. The mattress for ordinary and emergency use, according to claim 1, wherein the at least longitudinal pocket can be opened and closed.

6. The mattress for ordinary and emergency use according to claim 1, wherein when the padding is bent, the mattress embraces the user.

7. The mattress for ordinary and emergency use according to claim 1, wherein the padding can be bent along a line in the longitudinal direction to form a U-shape.

8. The mattress for ordinary and emergency use according to claim 1, wherein the at least one longitudinal pocket further comprises a longitudinal pocket fastener to close the at least one longitudinal pocket.

9. The mattress for ordinary and emergency use according to claim 8, wherein the longitudinal pocket fastener is at least one of a slide fastener, a plane fastener, a snap, or a stitch.

* * * * *